US005950858A

United States Patent [19]

Sergeant

[11] Patent Number: 5,950,858

[45] Date of Patent: Sep. 14, 1999

[54] CONTAINER END CLOSURE

[76] Inventor: David Robert Sergeant, Pucks Hollow, Reynoldstown, Swansea, SA3 1AR, United Kingdom

[21] Appl. No.: 08/507,339

[22] PCT Filed: Feb. 18, 1994

[86] PCT No.: PCT/GB94/00335

§ 371 Date: Oct. 2, 1995

§ 102(e) Date: Oct. 2, 1995

[87] PCT Pub. No.: WO94/19246

PCT Pub. Date: Sep. 1, 1994

[30] Foreign Application Priority Data

Feb. 18, 1993 [GB] United Kingdom ..... 9303218
Dec. 8, 1993 [GB] United Kingdom ..... 9325192

[51] Int. Cl.[6] ..... B65D 17/34

[52] U.S. Cl. ..... 220/269; 220/617; 220/619; 220/624

[58] Field of Search ..... 220/269, 270, 220/276, 615, 617, 618, 619, 620, 621, 622, 623, 624

[56] References Cited

U.S. PATENT DOCUMENTS

| | | | |
|---|---|---|---|
| 3,432,067 | 3/1969 | Khoury . | |
| 3,494,169 | 2/1970 | Sanders . | |
| 3,696,961 | 10/1972 | Holk, Jr. . | |
| 3,843,014 | 10/1974 | Cospen et al. | 220/623 |
| 3,893,325 | 7/1975 | Oberlander et al. . | |
| 4,055,134 | 10/1977 | Ostrem et al. | 220/276 X |
| 4,093,102 | 6/1978 | Kraska | 220/623 |
| 4,254,890 | 3/1981 | Westphal | 220/276 |
| 4,448,322 | 5/1984 | Kraska | 220/623 |
| 4,511,299 | 4/1985 | Zysset | 220/276 X |
| 4,832,223 | 5/1989 | Kalenak et al. . | |
| 5,038,956 | 8/1991 | Saunders | 220/271 |
| 5,105,977 | 4/1992 | Taniuchi | 220/712 |
| 5,152,421 | 10/1992 | Krause . | |
| 5,217,134 | 6/1993 | Saunders | 220/276 |

FOREIGN PATENT DOCUMENTS

| | | |
|---|---|---|
| 0241788 | 10/1987 | European Pat. Off. . |
| 0524098 | 1/1993 | European Pat. Off. . |
| 2112318 | 6/1972 | France . |
| 477766 | 5/1929 | Germany . |
| 2315832 | 10/1974 | Germany . |
| 59-225830 | 12/1984 | Japan . |
| 2205208 | 8/1990 | Japan . |
| 609907 | 10/1948 | United Kingdom . |
| 2040200 | 8/1980 | United Kingdom . |
| 2050879 | 1/1981 | United Kingdom . |
| 2060548 | 5/1981 | United Kingdom . |
| 2107273 | 4/1983 | United Kingdom . |
| 2191168 | 12/1987 | United Kingdom . |
| 2234197 | 1/1991 | United Kingdom . |
| 2241184 | 8/1991 | United Kingdom . |
| 9109784 | 7/1991 | WIPO . |

*Primary Examiner*—Stephen K. Cronin
*Attorney, Agent, or Firm*—Edwin D. Schindler

[57] ABSTRACT

An end closure for a container has a central panel, a circumferential countersink (18) formed around the center panel and adjacent the periphery of the end closure, and a fold (22) formed at the junction between the countersink and the center panel, the fold having opposite side walls which lie closely adjacent or in contact with each other and project upwards from the end closure. The fold may instead be formed at the base of the countersink. The fold forms an annular rigid zone in the end closure.

16 Claims, 4 Drawing Sheets

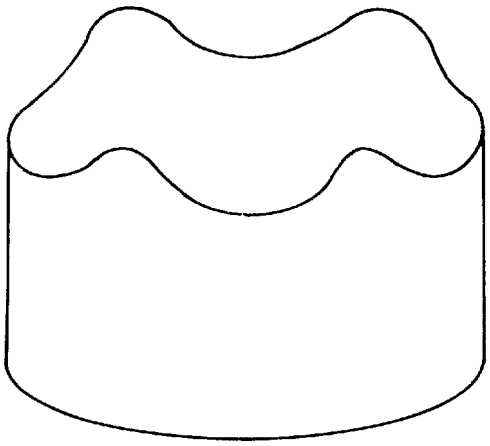
FIG. 12
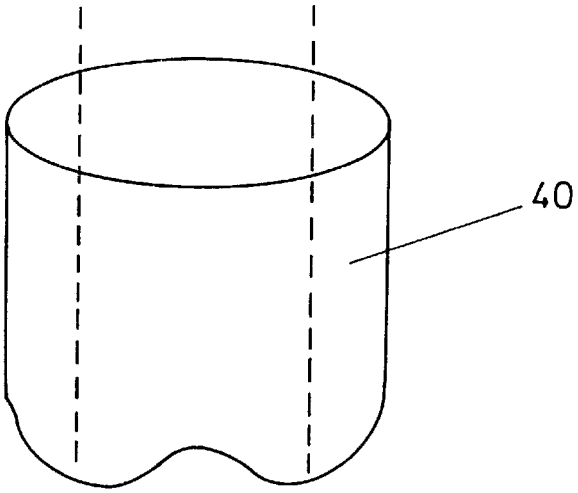
FIG. 13
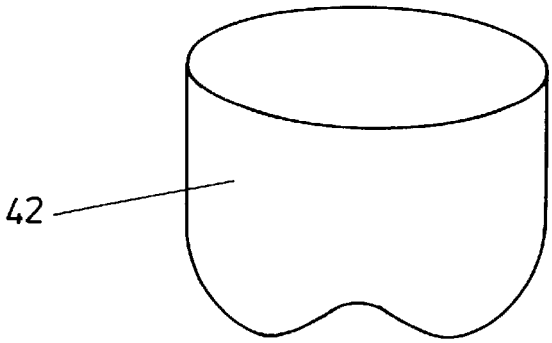

CONTAINER END CLOSURE

BACKGROUND OF THE INVENTION

1. Technical Field of the Invention

This invention relates to metal containers and more particularly to an end closure for carbonated drink cans, and which may have an easy-open aperture.

2. Description of the Prior Art

Carbonated drinks are commonly contained in cylindrical metal containers having a top end closure of sheet material which is provided with a ring pull or tab for the easy opening of an aperture prescored in the end closure. In the manufacturing process, the cylindrical containers are filled and then fitted with their top end closures to enclose the drink, whereafter the containers may be subjected to heat in order to pasteurise the contents. This heating process causes a temporary increase in the pressure within the containers. Also if subsequently the container is stored in a warm environment or is severely shaken, its internal pressure will greatly increase. In order to withstand increased internal pressure, it is common for the top end closure of these containers to be formed with a circumferential valley or countersink adjacent its periphery. Although the containers may be designed to withstand an industry standard pressure of 100 p.s.i., it is possible for the countersink to invert at a localised point under internal pressure created within the container. There has hitherto been a tendency to minimise the thickness or gauge of the sheet material used to make the end closure, because the cost of the sheet material used in the end closure forms a substantial proportion of the overall manufacturing cost of the container. However in order that the gauge of the sheet material used for the end closure can be reduced, it has been necessary to take measures to prevent the countersink locally inverting under the internal pressure within the container. One proposal is given in U.S. Pat. No. 4,093,102 and relates to providing the countersink with a specific cross-sectional profile, such that the opposite walls of the countersink will move in response to internal pressure, the countersink thus adopting a modified profile having increased resistance to inverting. Another proposal is given in U.S. Pat. No. 4,832,223 and relates to coining the end closure around an annular region at the junction of the countersink with the centre panel of the end closure.

SUMMARY OF THE INVENTION

I have now devised a container end closure having an improved arrangement for resisting internal pressure within the container.

In accordance with this invention as seen from one aspect, there is provided a sheet material end closure for a container, the end closure having a centre panel optionally provided with an easy-opening means, a circumferential countersink formed around the centre panel and adjacent the periphery of the end closure, and a fold formed at the junction between the countersink and the centre panel, said fold having opposite side walls which lie closely adjacent or in contact with each other and which project upwards from the end closure, or the fold being formed at the base of the countersink, the fold forming an annular rigid zone in the end closure.

The fold which is provided in accordance with this invention forms a rigid annular zone at an area of potential deformation, by increasing the volume of metal which has to be deformed if the countersink is to invert. Therefore the fold provides effective resistance against the countersink inverting, even at localised points around its circumference.

In embodiments having the fold formed at the junction between the countersink and the centre panel, the fold may be left projecting upwards from the centre panel. In another embodiment the fold may be bent radially inwardly, either to lie at an acute angle to the centre panel or to lie flat against the centre panel. In a further embodiment the fold may be bent outwardly, e.g. to lie flat against the radially inner side wall of the countersink.

The facing surfaces of the fold may have adhesive applied to them so that the opposite side walls of the fold bond together, to improve the strength of the fold. Alternatively, the sheet material from which the end closure is made may have a thermoplastic coating, in which case heat may be applied to bond together the opposite side walls of the fold.

Because of the resistance provided by the fold against the countersink inverting, the end closure may be made from thinner gauge sheet material than hitherto. Alternatively, sheet material of lesser inherent strength may be used: this material may be of thicker gauge yet less expensive than the material conventionally used.

The use of thicker gauge sheet material has certain advantages: for example it is easier to form, from the material in the centre panel, the rivet for the pull-tab; also it is easier to form a score of adequate depth around the intended opening in the centre panel, without the risk that the line around this opening will be too weak.

However, if a thicker gauge material is used for the end closure, it becomes difficult to fit the end closure to filled containers using the same machine which is used to fit end closures of conventional gauge material. Thus, in fitting an end closure to a filled container, the outer peripheral rim of the end closure is folded inside an outwardly-projecting peripheral flange at the top of the container, and a seam is formed by rolling: because three layers of the end closure material and two layers of the container material are rolled together, relatively little variation in the end closure thickness can be tolerated without changing the pressures and profiles of the rolling dies.

I have now devised arrangements which enable end closures of thicker gauge material to be fitted to containers without modification to the machine which is used for the fitting.

Thus, in accordance with this invention as seen from a second aspect, there is provided a sheet material end closure for a container, the end closure having a peripheral margin or other annular zone of reduced thickness.

This end closure may be formed of sheet material of thicker gauge than usual, but its reduced-thickness peripheral margin enables it to be fitted to a container using the machine used to fit end closures of conventional gauge material.

Further in accordance with this invention as seen from a third aspect, there is provided a method of forming a container end closure with a peripheral margin or other annular zone of reduced-thickness, comprising punching a sheet material end closure blank through a die using a punch having a clearance, between itself and at least some portion of the die, of less than the thickness of said sheet material, the end closure blank having a size greater than the opening through the die.

In use of this method to form the end closure blank with a reduced-thickness margin, as the punch starts to drive the end closure blank through the die, the peripheral margin of the blank becomes bent up around the punch. Then as the punch continues to drive the blank through the die, the peripheral margin becomes reduced in thickness because the clearance between the punch and the die is less than the starting thickness of the end closure. A cup-shaped preform with a reduced-thickness peripheral wall is thus formed. The process can be arranged so that the integrity of any coating on the end closure blank is maintained. A similar process may be used to produce intentional thinning of the metal at an annular zone in the finished end other than the rim, particularly the wall of the centre panel as the centre panel is formed by raising the centre bottom of the cup-shaped preform.

After this process has been carried out on the end closure blank, further forming processes are then carried out to produce a final end closure having the desired profile and optionally an easy-open aperture.

When a sheet metal blank is drawn into a cup-shape, for example as described above, often it will thin preferentially in certain zones. This is known as "earing" and results because the rolling processes used to form sheet metal impart axes of relatively easy slip into the metal. Accordingly, if a circular blank is drawn into a cup-shape, its rim will not be flat, but wavy, the peaks being known as "ears". It is undesirable for the edge of a finally-produced end closure to exhibit excessive waviness, because this leads to unacceptable variations in the amount of metal in the seam of the completed container. Often this effect is compensated for by starting with a non-circular blank, having smaller initial diameters in the directions of earing.

I have now devised an alternative arrangement to compensate for the earing effect, and increase the strength of the closure, Thus in accordance with this invention as seen from a fourth aspect, there is provided a method of forming a cup-shape article from a circular blank of sheet material exhibiting one or more preferred directions of slip, comprising drawing the blank using a punch having a nose which is profiled and so oriented relative to the blank that the rim of the cup-shape article thus formed is substantially flat.

The cup-shape article is further processed, using subsequent punches of similarly varying profiles, to produce an end closure of the required form, arranged so that the excess metal due to earing is drawn into the centre panel area.

BRIEF DESCRIPTION OF THE DRAWING FIGURES

Embodiments of this invention will now be described by way of examples only and with reference to the accompanying drawings, in which:

FIG. 12 is a view of a cup-shape end closure preform produced by drawing a circular blank of sheet metal having preferential directions of slip; and FIG. 13 is a diagrammatic view of a punch used to draw an end closure preform without "earing".

DETAILED DESCRIPTION OF THE DRAWING AND PREFERRED EMBODIMENTS

Figure 1:
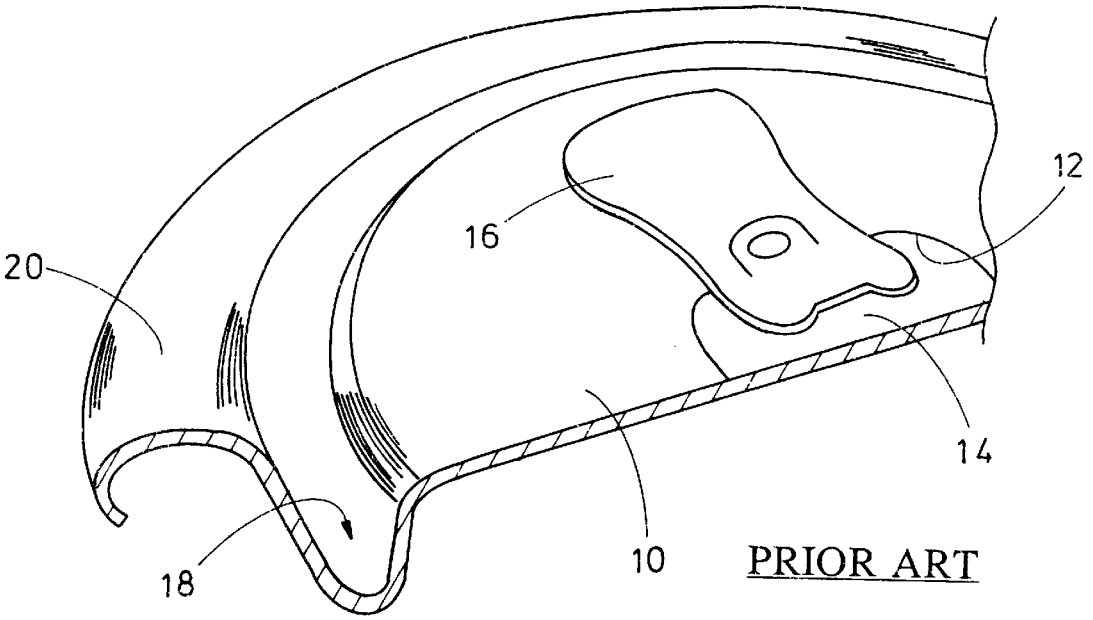
FIG. 1 is a part view of a prior art end closure for a container.

Referring to FIG. 1 of the drawings, there is shown a prior art aluminium end closure for a cylindrical metal container used for holding carbonated drinks. The end closure is formed from sheet material and has a circular centre panel 10 which is formed with a line of weakness 12 around a region 14 which has a tab rivetted to it. When the tab 16 is raised by the user's finger, the region 14 tears from the panel along the line 12, to form an aperture in the end of the container, this aperture being small compared to the overall size of the centre panel. The end closure is formed with a circumferential valley or countersink 18 adjacent the periphery of the centre panel 10, and with an annular peripheral portion or margin 20 which extends around the countersink 18 and curves inwardly at its outer edge. In manufacture, each cylindrical container is filled with carbonated drink and then an end closure as shown is applied to the top of the container and sealed thereto by folding over the outer edge of the portion 20 with the top edge of the container. Then the filled and sealed containers are heated to pasteurise their contents.

Figure 2:
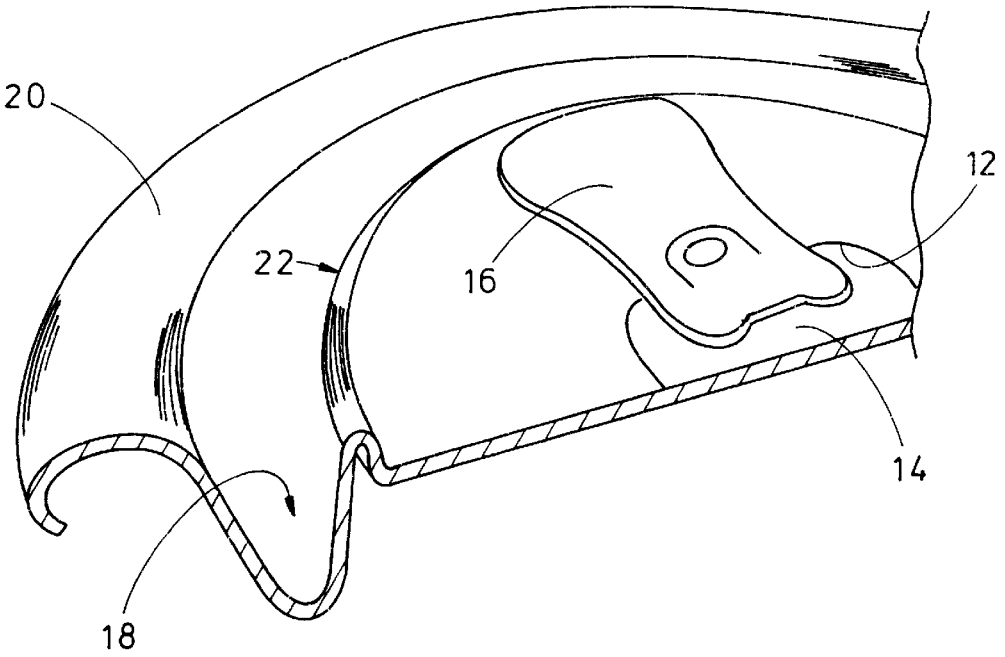
FIG. 2 is a similar view of one embodiment of end closure in accordance with the invention.
Figure 3:
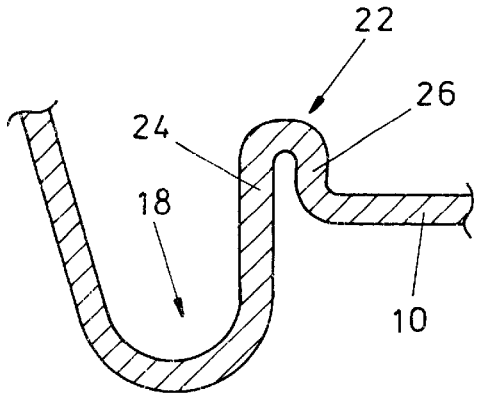
FIG. 3 is a section through the countersink and fold region of the end closure of FIG. 2, on an enlarged scale.

In accordance with this invention and as shown in FIGS. 2 and 3, the end closure is formed with a fold 22 at the junction between its countersink 18 and its centre panel 10. The opposite side walls 24, 26 of this fold 22 are brought closely adjacent each other or ideally into face-to-face contact, and ideally are generally flat and parallel to each other. The side walls 24, 26 of the fold 32 project upwardly relative to the centre panel 10.

Figure 4:
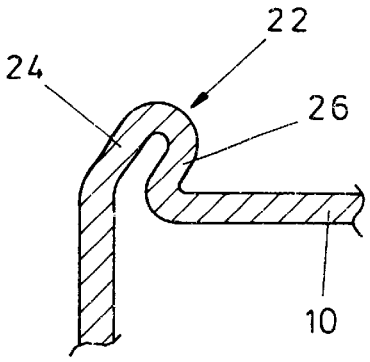
FIG. 4 is a similar section of a second embodiment of end closure.

In the embodiment shown in FIG. 4, the fold 22 has been bent radially inwardly for its side walls to lie at an acute angle to the centre panel 10.

Figure 5:
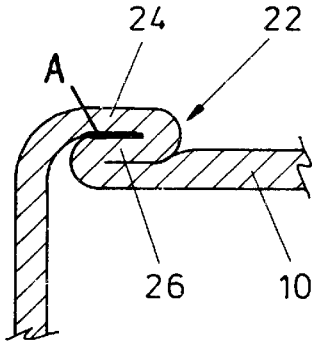
FIG. 5 is a similar section of a third embodiment of end closure.

In the embodiment shown in FIG. 5, the fold 22 has been bent radially inwardly and flattened against the top of the centre panel 10. In this embodiment the opposite walls 24 26 of the fold 22 are in face-to-face contact with each other and the wall 26 is in face-to-face contact with the top of the centre panel.

Figure 6:
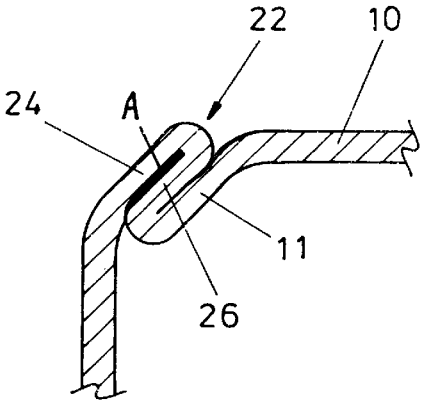
FIG. 6 is a similar section of a fourth embodiment of end closure.

In the embodiment shown in FIG. 6, the centre panel 10 has been raised but leaving a peripheral margin 11 thereof inclined downwardly. The fold 22 has its opposite walls flattened together and it is itself flattened against the inclined margin 11 of the centre panel.

Figure 7:
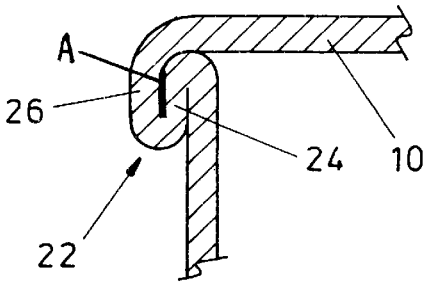
FIG. 7 is a similar section of a fifth embodiment of end closure.

In the embodiment of FIG. 7, the fold 22 has bent radially outwardly and downwardly until its wall 24 lies face-to-face against the radially inner side wall of the countersink.

Figure 8:
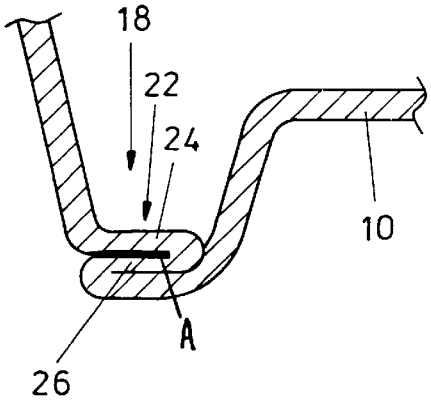
FIG. 8 is a similar section of a sixth embodiment of end closure, in which the fold is formed at the base of the countersink.

FIG. 8 shows a fold 22 formed in the base of the countersink 18. In this example the opposite side walls 24, 26 are in face-to-face contact with each other and the fold 22 is bent over so that its side walls 24, 26 lie horizontally with side wall 26 in contact with a portion of the countersink at its base.

The folds 22 of FIGS. 5 to 8 may be compressed by applying a force perpendicular to the plane of the fold 22 so as to cause a reduction in the gauge of the sheet material over all or part of the fold.

The folds 22 of the end closures of FIGS. 2 to 8 may have adhesive (A)applied to them so that their opposite side walls 24, 26 bond together. Alternatively, the sheet material from which the end closure is made may have a thermoplastic coating, in which case heat may be applied to bond together the opposite side walls 24, 26 of the fold 22.

In all of the embodiments shown in FIGS. 2 to 8, the fold 22 forms a rigid annular zone in the countersink 18 of the end closure. This provides effective resistance against the countersink 18 inverting, even at localised points around its circumference, under pressure within the container especially when the container is being subjected to heat or when it has been shaken. This moreover enables thinner gauge aluminium or other sheet material to be used for the end closure than has hitherto been possible: alternatively sheet material of lesser inherent strength can be used—this may be of thicker gauge but still less expensive than the material conventionally used.

Figure 9:
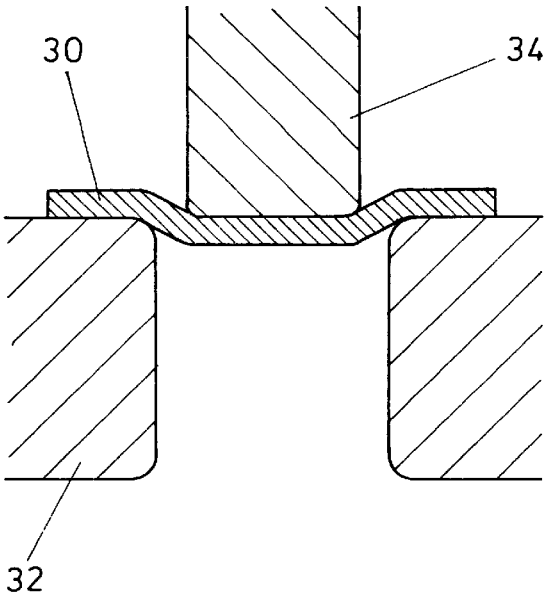
FIGS. 9 to 11 are diagrammatic sectional views through a drawing apparatus, at three successive stages in its use, to form an end closure blank with a reduced-thickness peripheral margin.
Figure 10:
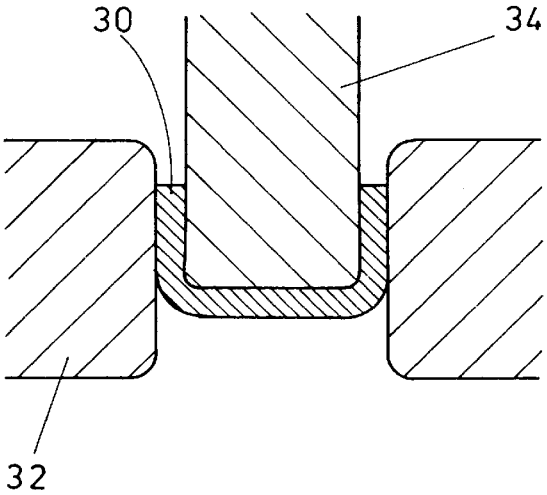
Figure 11:
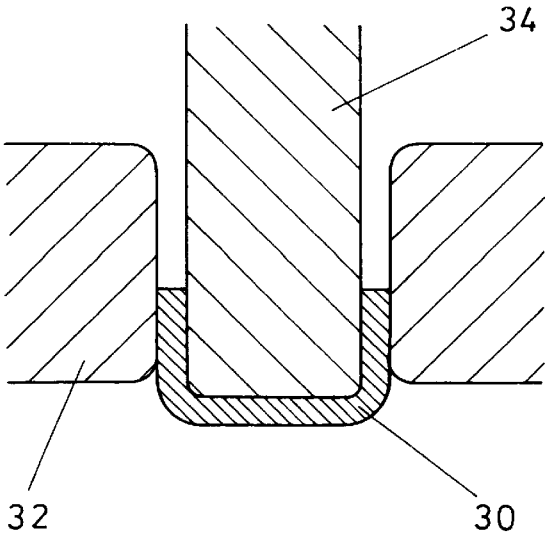

As explained above, if the end closure is of thicker gauge than normal, it is desirable to be able to fit the end closure to a filled container using the same machine, without modification, as is used to fit end closures of conventional gauge material. Referring to FIGS. 9 to 11, for this purpose the end closure is formed with a peripheral margin of reduced thickness. Thus, a circular end closure blank 30 is punched through a die 32 using a punch 34, the difference in radius between the punch 34 and at least some portion of the opening through the die being less than the starting thickness of the blank 30. As the punch starts to drive the blank 30 through the die (the opening through the die being smaller in diameter than the blank 30), a peripheral margin of the blank becomes bent up around the punch. Then as the punch continues to drive the blank through the die, this peripheral margin is reduced because the clearance between the punch and die is less than the starting thickness of the blank. There is thus produced a preform of generally cup-shape, the upstanding margin being of reduced thickness. This preform is then further processed to produce a final end closure of the required form, e.g. as shown in any of FIGS. 2 to 8 but with the margin 20 of reduced thickness. Optionally also, a similar process may be carried out, when forming the centre panel by raising the centre-bottom of the cup-shape preform, to form the side walls of the centre panel to a reduced thickness.

As explained above and as shown in FIG. 12, a circular sheet metal blank when drawn often has a wavy rim, the effect being known as "earing" and the peaks in the rim being known as ears. This results from preferential directions of slip induced in the sheet metal by the rolling processes used to form it, the ears corresponding to these preferred directions.

In order to avoid this, and in accordance with this invention, a circular sheet metal blank is drawn using a punch 40 having a profiled nose (FIG. 13) so that the cup-shaped article or end closure preform 42 which is formed has a substantially flat rim. Thus, the periphery of the punch nose is undulating in shape, each peak tapering (on the nose end of the punch) towards the centre of the nose (on the axis of the punch). The punch is oriented relative to the preferential slip directions of the blank, so that the peaks on the end of the punch stretch the blank further, in the axial direction, in correspondence of the preferential directions of slip of the sheet metal, with the result that the rim of the cup-shaped article 42 is substantially flat.

The article 42 is then further processed to produce a final end closure of the required form, e.g. as shown in any of FIGS. 2 to 8. This further processing uses subsequent punches or sets of punches having profiles varying in similar manner to punch 40 described above, arranged so that the excess metal due to earing is drawn into the centre panel area. A deeper panel results in a stronger end closure, so that an end closure with a deeper panel at positions of most earing has a greater local panel strength and therefore greater overall strength, with the potential for further savings in metal usage by using a thinner gauge starting material.

I claim:

1. A sheet material end closure for a container, comprising:

an end closure having a center panel;

a circumferential countersink formed around said center panel, said countersink being in a form of a valley having opposite inner and outer side walls and an interconnecting bottom portion, with the inner side wall extending substantially vertically downwards from the center panel; and, an annular peripheral rim portion extending from, and disposed around, said circumferential countersink, said annular peripheral rim portion being at an extreme outer edge of said end closure and being curved in section and being of reduced thickness as compared with said center panel.

2. The sheet material end closure according to claim 1, wherein said center panel is formed with a line of weakness around a localized region, for permitting tearing along the line of weakness for forming a corresponding aperture.

3. The sheet material end closure according to claim 1, further comprising an additional annular zone also of reduced thickness as compared with said center panel.

4. The sheet material end closure according to claim 3, wherein said additional annular zone comprise a side wall of said center panel.

5. The sheet material end closure according to claim 1, further comprising a fold formed at a base of said circumferential countersink, said fold having opposite side walls which lie closely adjacent, or in contact with, each other, and form a rigid annular zone in said end closure.

6. The sheet material end closure according to claim 5, wherein the opposite side walls of said fold are bonded together.

7. The sheet material end closure according to claim 1, further comprising a fold formed at a junction between said circumferential countersink and said center panel, said fold having opposite side walls which lie closely adjacent, or in contact with, each other, said fold forming a rigid annular zone in said end closure.

8. The sheet material end closure according to claim 7, wherein said fold is bent radially inwardly to lie flat against said center panel.

9. The sheet material end closure according to claim 7, wherein said center panel has a downwardly-inclined peripheral margin, said fold being bent radially inwardly to lie against said downwardly-inclined peripheral margin.

10. The sheet material end closure according to claim 7, wherein opposite side walls of said fold are bonded together.

11. The sheet material end closure according to claim 7, wherein said fold projects upwardly from said center panel.

12. The sheet material end closure according to claim 11, wherein said fold is bent radially inwardly to lie at an acute angle to said center panel.

13. The sheet material end closure according to claim 7, wherein said fold is bent radially outwardly.

14. The sheet material end closure according to claim 13, wherein said fold lies flat against a radially inner side wall of said circumferential countersink.

15. A method for forming a container end closure, comprising the steps of:

providing a sheet material end closure blank;

punching said end closure blank through a die using a punch having a clearance, between itself and at least a portion of the die, of less than the thickness of said sheet material end closure blank, said end closure blank having a size greater than an opening through the die for forming a peripheral rim portion of said blank to a reduced thickness;

forming a circumferential countersink in said end closure blank between a center panel and said peripheral rim portion; and, forming said peripheral rim portion to a curved section.

16. The method for forming a container end closure according to claim 15, wherein said end closure blank is circular in shape and of a material exhibiting at least one direction of slip, said punch having a nose which is profiled and oriented relative to said end closure blank so that said punching step forms said end closure blank to a cup shape having a rim which is substantially flat.

* * * * *